US009402482B2

(12) United States Patent
Miller

(10) Patent No.: US 9,402,482 B2
(45) Date of Patent: Aug. 2, 2016

(54) POSTURE SUPPORT SYSTEM

(71) Applicant: Lowell G. Miller, Woodstock, NY (US)

(72) Inventor: Lowell G. Miller, Woodstock, NY (US)

( * ) Notice: Subject to any disclaimer, the term of this patent is extended or adjusted under 35 U.S.C. 154(b) by 0 days.

(21) Appl. No.: 14/534,625

(22) Filed: Nov. 6, 2014

(65) Prior Publication Data

US 2015/0123450 A1 May 7, 2015

Related U.S. Application Data

(60) Provisional application No. 61/900,538, filed on Nov. 6, 2013.

(51) Int. Cl.
*A47D 15/00* (2006.01)
*A47C 16/00* (2006.01)
*A47C 9/00* (2006.01)

(52) U.S. Cl.
CPC ..... *A47C 16/00* (2013.01); *A47C 9/005* (2013.01)

(58) Field of Classification Search
CPC ..... A47C 9/025; A47C 1/031; A47C 16/00; A47C 20/047; B60N 2/4879; B60R 21/02
USPC ..... 297/487, 488, 410, 409; 108/147.2; 248/397; 128/845
See application file for complete search history.

(56) References Cited

U.S. PATENT DOCUMENTS 483,266 A 9/1892 Schindler
2,632,497 A * 3/1953 Brady ..... B60N 2/4879 297/230.11
3,754,787 A * 8/1973 Garber ..... A61B 19/28 297/195.11
3,929,309 A * 12/1975 De Vore ..... A47C 1/06 248/118
4,390,011 A * 6/1983 Evans ..... A61B 19/28 108/6
4,650,249 A * 3/1987 Serber ..... A47C 9/005 248/397
4,809,997 A * 3/1989 Owens ..... A61G 5/14 280/211
4,832,407 A 5/1989 Serber
5,022,622 A * 6/1991 Schaevitz ..... A47B 21/0371 182/230
D331,921 S * 12/1992 Gutke ..... D14/452
5,177,823 A * 1/1993 Riach ..... A47C 7/38 297/408
5,288,042 A * 2/1994 Grimm ..... A47B 21/0371 248/118
5,385,322 A * 1/1995 Kim ..... A47B 21/0371 248/118
5,529,383 A 6/1996 Laco
5,560,573 A * 10/1996 Colver ..... F16M 11/28 248/118

(Continued)

FOREIGN PATENT DOCUMENTS

JP 2000079143 A 3/2000
JP 2008000240 A 1/2008

(Continued)

*Primary Examiner* — Laurie K Cranmer
(74) *Attorney, Agent, or Firm* — Gloria Tsui-Yip, Esq; Miskin & Tsui-Yip LLP

(57) ABSTRACT

A posture support system that includes a base portion, a vertical arm portion extending from the base portion, a horizontal arm portion extending from the vertical arm portion, and a support portion extending from the horizontal arm portion. The base portion includes a rectangular board that rests on a flat surface. The vertical arm and horizontal arm portions are fully adjustable to accommodate different users when a user rests against the support portion to perform work, such as typing, on the flat surface. The posture support system induces proper seated posture.

16 Claims, 17 Drawing Sheets

(56) References Cited

U.S. PATENT DOCUMENTS 5,762,402 A * 6/1998 Gillotti ..... A61G 15/007 297/338
5,845,884 A * 12/1998 Terbrack ..... A47B 21/0371 248/118
5,884,935 A * 3/1999 Tholkes ..... A61G 5/14 280/650
6,076,846 A * 6/2000 Clardy ..... B62J 1/28 248/299.1
6,095,607 A * 8/2000 Wenzel ..... A47C 3/34 297/118
6,102,344 A * 8/2000 Kasvin ..... A61B 19/28 248/118
6,267,336 B1 * 7/2001 Ruckstadter ..... A47B 21/0371 248/118.3
6,427,273 B1 * 8/2002 Berke ..... A47C 16/00 248/118
6,447,070 B1 * 9/2002 Ekman ..... A47C 3/16 297/344.12
6,454,224 B1 9/2002 Nogueira
6,540,301 B1 * 4/2003 Bottoms ..... A47C 9/025 135/65
6,619,747 B2 9/2003 Ko et al.
6,698,831 B2 * 3/2004 Lloyd ..... A47C 9/005 297/195.11
6,721,978 B1 * 4/2004 Tankersley ..... A47C 16/00 297/391
6,758,447 B2 * 7/2004 Tinsley ..... A61G 13/12 248/118
6,772,980 B2 8/2004 O'Neill
6,857,149 B2 * 2/2005 Hoggatt ..... A47C 20/026 5/632
7,108,321 B2 * 9/2006 Davis ..... A47C 4/04 297/230.1
7,673,836 B2 * 3/2010 Wallock ..... A47C 16/00 248/118
7,837,274 B2 * 11/2010 Abdoli-Eramaki .... A47C 1/022 297/463.2
8,042,775 B1 * 10/2011 Gallegos ..... A47C 16/00 248/118
D683,463 S * 5/2013 Huggins ..... D24/184
8,584,283 B2 * 11/2013 Mabry ..... A47C 16/00 190/2
2002/0184706 A1 * 12/2002 Riach ..... A61B 6/0421 5/632
2003/0034037 A1 * 2/2003 Klemm ..... A61B 19/28 128/845
2003/0150611 A1 8/2003 Buytaert
2004/0226567 A1 * 11/2004 Klemm ..... A61B 19/28 128/845
2007/0236057 A1 * 10/2007 Smith ..... A47C 1/143 297/183.2
2008/0203249 A1 * 8/2008 Priest ..... A61F 5/3761 248/118
2009/0050162 A1 2/2009 Turner et al.
2009/0272779 A1 11/2009 Vu
2009/0278391 A1 * 11/2009 Ulrich ..... A47C 7/443 297/283.1
2009/0324024 A1 12/2009 Worthington
2010/0295357 A1 * 11/2010 Koehler ..... A47C 1/04 297/411.2
2011/0054372 A1 3/2011 Murnaghan
2011/0127391 A1 * 6/2011 McDonald ..... A47C 7/38 248/118
2011/0275939 A1 11/2011 Walsh et al.
2014/0059773 A1 * 3/2014 Carn ..... A61G 13/123 5/624
2014/0325741 A1 * 11/2014 Zaouk ..... B60N 2/4879 2/173
2015/0001905 A1 * 1/2015 Jackow ..... B60N 2/4805 297/397
2015/0208800 A1 * 7/2015 Yang ..... A61F 5/00 297/488

FOREIGN PATENT DOCUMENTS

JP 2008183338 A * 8/2008
KR 101192590 B1 * 10/2012
KR 20130109696 A * 10/2013
KR 20130129161 A * 11/2013
WO 2005023072 A1 3/2005
WO WO 2013002453 A1 * 1/2013 ..... A47C 16/00
WO WO 2013125907 A1 * 8/2013 ..... A47B 97/00
WO WO 2015069862 A1 * 5/2015 ..... A47C 9/005

* cited by examiner

POSTURE SUPPORT SYSTEM

This application claims the benefit of provisional patent application Ser. No. 61/900,538, filed on Nov. 6, 2013, which is hereby incorporated by reference.

FIELD OF THE INVENTION

The present invention relates to an system that improves a user's sitting posture. In particular, the system improves posture of a user while sitting at a desk.

BACKGROUND OF THE INVENTION

As more people use computers in the workplace, proper posture when sitting is increasingly becoming a personal and economic issue. Billions of dollars are lost each year by companies through lost productivity and health care costs due to cases of back pain caused by prolonged sitting behind computers and at factory work stations. Back pain is a leading contributor to losses in workplace productivity in the United States. According to one 2006 study, back pain was reported by 42.6% of workers surveyed, and "back pain in workers 40 to 65 years of age costs employers an estimated $7.4 billion/year." The American Association of Orthopaedic Surgeons reports that a total of 186.7 million work days were lost in 2004 due to back pain. Such pain plays a major role in increasing health costs and reducing the quality of people's lives. It would appear, that as individuals spend more time in front of computers, the incidence of such back problems has increased. A 2008 article published in the *Journal of the American Medical Association* estimates that healthcare expenditures related to spine problems in the United States totaled $89.5 billion in 2005, a 65% increase from expenditures in 1997.

The Mayo Clinic points to improper posture as one of the major causes of back pain in the workplace, and recommends proper posture while sitting as a step to prevent back pain and injury at work. Proper posture involves keeping both feet on the ground and knees level with hips. The lower back should be properly supported, and sitters should be upright and relaxed, neither slumping over nor arching their backs. While ergonomically designed chairs can help sitting posture, and individuals can work to train themselves to sit properly, most people tend to become lapse and have difficulty maintaining good habits.

One of the most common posture problems, called kyphosis, is a direct result of spending too much time in front of a computer, experts say. The shoulders hunch forward, the pectoral muscles in the chest tighten, the neck and head extend toward the computer screen, and the spine is no longer vertically aligned. Many deskbound office workers have started standing and walking in this position, too, says Andrea Cheville, a rehabilitation physician at the Mayo Clinic in Rochester, Minn. To counteract kyphosis, it is important to stretch the pectoral muscles and strengthen the trapezius muscles in the upper back, which hold the shoulder blades back, Dr. Cheville said. Remembering to keep the ears and head over the shoulders, and not jutting forward, is also important.

Posture is "probably the 800-pound gorilla when it comes to health and wellness," says Allston Stubbs, an orthopedic surgeon at Wake Forest Baptist Medical Center, in Winston-Salem, N.C., who treats patients with back or joint pain. "We see the spine and overall skeletal structure being critical to a patient's functionality and their satisfaction with their life and health care." Billions of dollars are being spent by government, companies and individuals on functional health problems that are all too frequently a result of simple poor posture at work. And tens of millions of people are forced to suffer pain in their everyday lives, pain that might have been avoided with proper working posture. Yet the prior attempts at helping resolve this problem have fallen short. There are many "ergonomic" chairs that help support a user's back, but these are premised on older ways of working, such as sitting back in a chair and speaking on the phone. In fact, in the digital age workers are leaning forward to view a screen, and back support is not really helpful, since when leaning forward a worker's back is not in contact with the chair.

As mentioned above, typical prior art for ergonomic workstations is in the form of a chair. This type of prior art chair has a back support that follows the contour of the natural curvature of the spine but the user is required to sit with his back against the back support for the entire spine to be supported. However, when a user is sitting and working at a desk, the user often leans forward towards the desk, slouches and not utilizes the back support of the chair for support. By leaning forward or slouching, users risk straining the piriformis muscle and sciatic nerve, the two main causes of pain in the lower back and buttocks. Sciatica and "piriformis syndrome," neuromuscular disorders that cause pain, tingling and numbing in the buttocks that extend down the leg, are the main causes for ergonomic-related worker absenteeism. According to the Mayo Clinic, slouching exaggerates a back's natural curves, which can lead to muscle fatigue and injury. Leaning forward, particularly under stress for long periods of time, strains muscles.

Other prior art that attempts to provide posture support when a user leans forward also takes the form of a chair. Instead of a back support, a front support is provided at the front of the chair. See U.S. Pat. Nos. 6,619,747, 4,832,407, and 3,754,787. In order for such chair to provide proper support, the user must straddle the chair and sit with his chest against the front support. The requirement to straddle such prior art chair is inconvenient for some users and may be difficult for users with mobility issues, as well as challenging for female users, who make up a large percentage of the computer-working population.

One major disadvantage of the prior art chairs is that they are typically configured to be "one size fit all." While certain adjustments can be made to customize prior art chairs (e.g. tilt of a chair seat, reclining angle of a chair back support, seat height adjustment, etc.), it typically has a limited range of adjustments.

Therefore, there is a need for an improved portable posture support system that addresses the work-posture problem for all users from the front, not the back, while a user is at a desk that is convenient to use and convenient for the user to ensure proper posture while seated.

SUMMARY OF THE INVENTION

The present invention is a posture support system that makes use of a desk for stabilization, and is not a chair.

The posture support system of the present invention comprises a base portion, a vertical arm portion extending from the base portion, a horizontal arm portion extending from the vertical arm portion, and a support portion extending from the horizontal arm portion. The interaction among the vertical arm portion, horizontal arm portion and support portion are fully adjustable to accommodate all different users.

The posture support system of the present invention comprises a rectangular base the size of a computer keyboard to which is attached an adjustable vertical arm. Attached to the vertical arm is a horizontal arm with a cushion support.

The posture support system of the present invention is placed on a flat surface, such as a desk. The base portion is removably positioned on the flat surface, as far or close to the edge of the flat surface according to the needs of the user. The base portion may have a lip that extends downward over the edge of a desk, which serves to prevent movement of the base portion and optionally allows the base portion to be fixedly attached to the desk by any fastening means. The vertical arm portion is preferably slightly curved towards the user and adjustable to different heights according to the user's height. The horizontal arm portion includes a pivotable joint that allows the support portion (cushion) to be adjusted and positioned at different height and angle for the user's comfort when the user's upper chest rests against the support portion. The design of the system provides resistance and spinal support for a user who tends to lean forward or slouch while seated at a desk. The system can be temporarily or permanently mounted to a flat surface, such as a desk.

The posture support system of the present invention is designed to provide resistance for a user who leans toward his workstation and to physically support a user in maintaining a seated position that adheres to ergonomic standards. The posture support system of the present invention is designed to induce proper seated posture from a biomechanical perspective, which, according to a consensus of medical experts, includes: (1) aligning ears over the shoulders; (2) shoulder over hips; and (3) thighs and arms perpendicular to the body. Failing to hold such posture, it is necessary for the user's back muscles to "hold up" the torso, and this constant muscular strain leads to back pain and pressure over time that degrades the spinal disks.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENT

Figure 1:
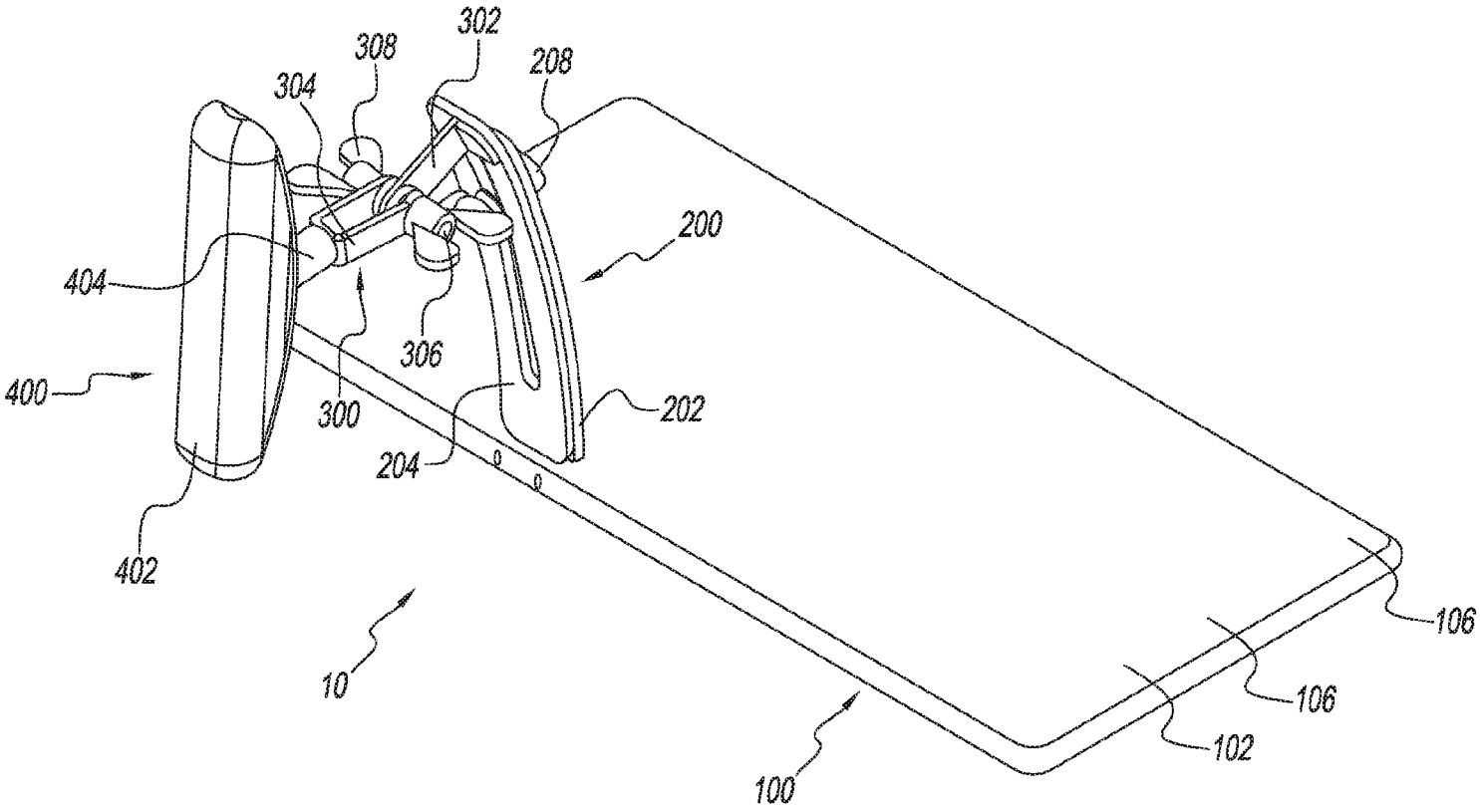
FIG. 1 is a perspective view of the present invention in a refracted position.

With reference to the drawings, wherein the same reference number indicates the same element throughout, there is shown in FIGS. 1 to 7, a posture support system 10 of the present invention. As shown in FIG. 1, posture support system 10 comprises a base portion 100, a vertical arm portion 200, a horizontal arm portion 300, and a support portion 400.

The base portion 100 comprises a rectangular shape board 102. Although board 102 is shown to be rectangular shape, board 102 can have other shapes such as oval, circle, or other geometric or non-geometric shapes. Preferably board 102 has a plurality of removable adhesive tapes 104 (such as 3M® Scotch® Restickable tabs for mounting) attached to the bottom of the board 102 such that the board can be removably secured on a flat surface. Board 102 can also be removably secured to the flat surface with Velcro® or similar hook and loop materials; suction devices, clamping devices, etc. Alternatively, board 102 may have a plurality of openings 106 for receiving fasteners that secure the board 102 onto the flat surface.

Figure 2:
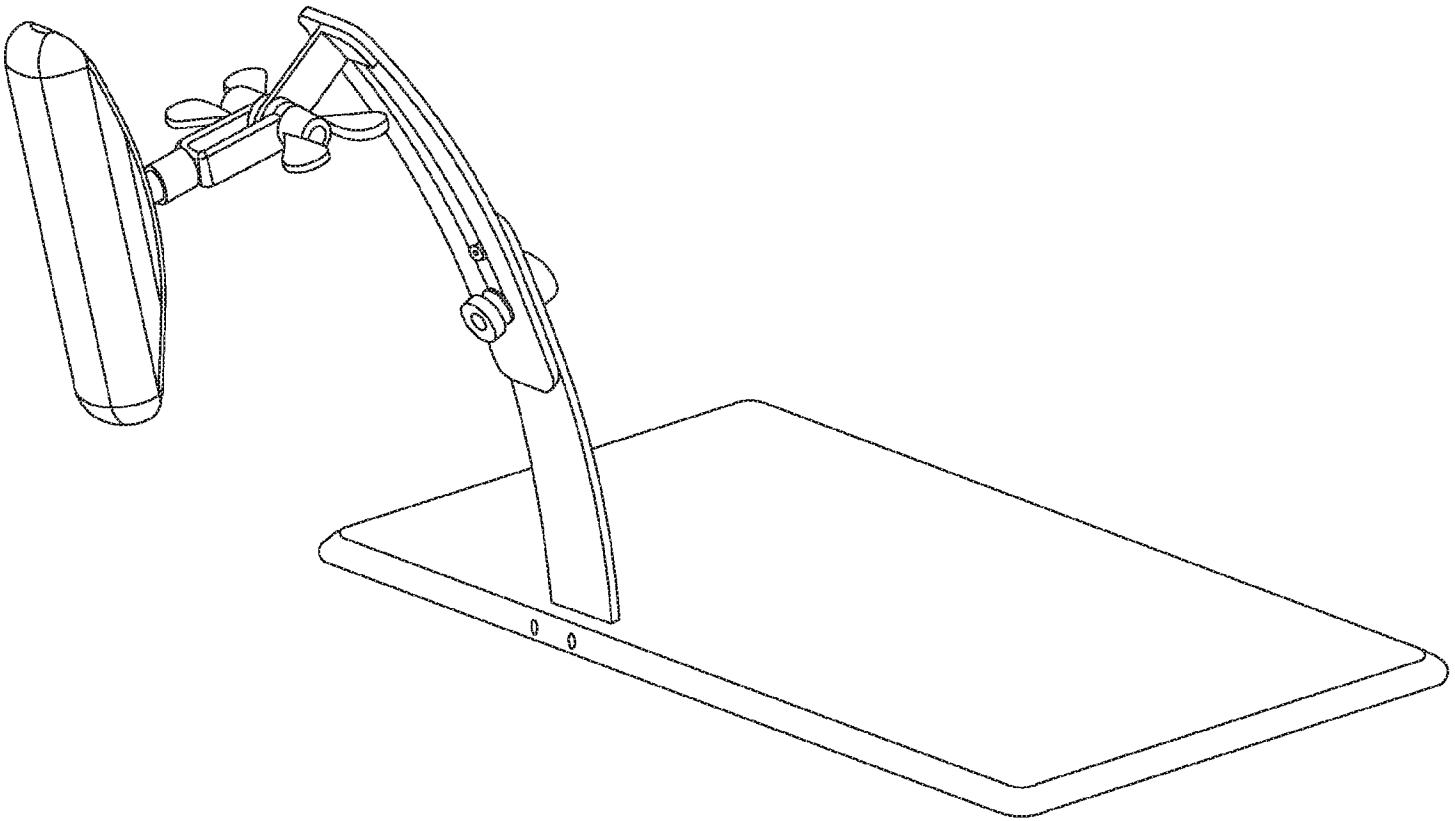
FIG. 2 is a perspective view of the present invention in an extended position.
Figure 3:
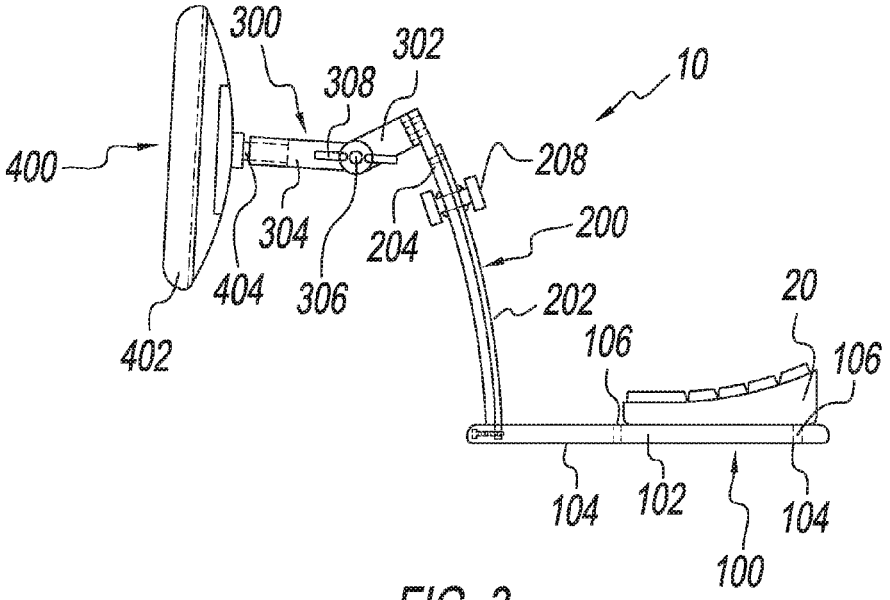
FIG. 3 is a side view of FIG. 1 with a keyboard in position.
Figure 4:
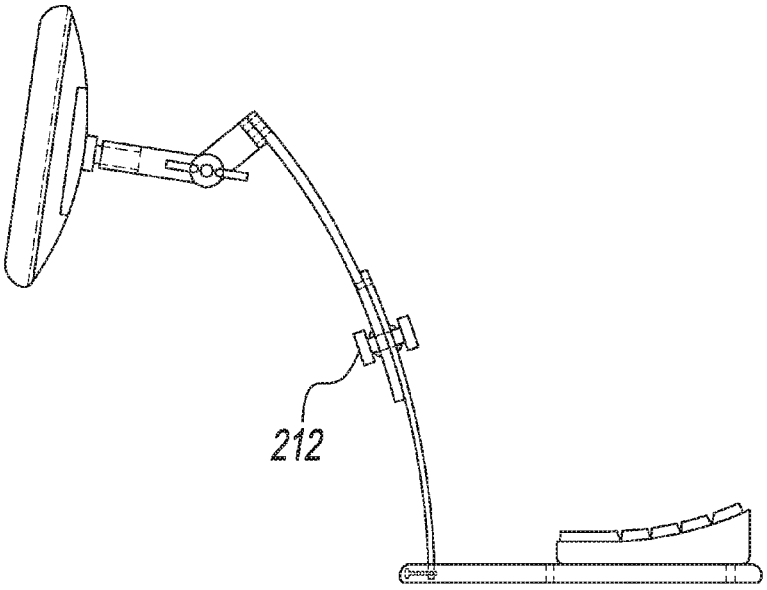
FIG. 4 is a side view of FIG. 2 with a keyboard in position.
Figure 5:
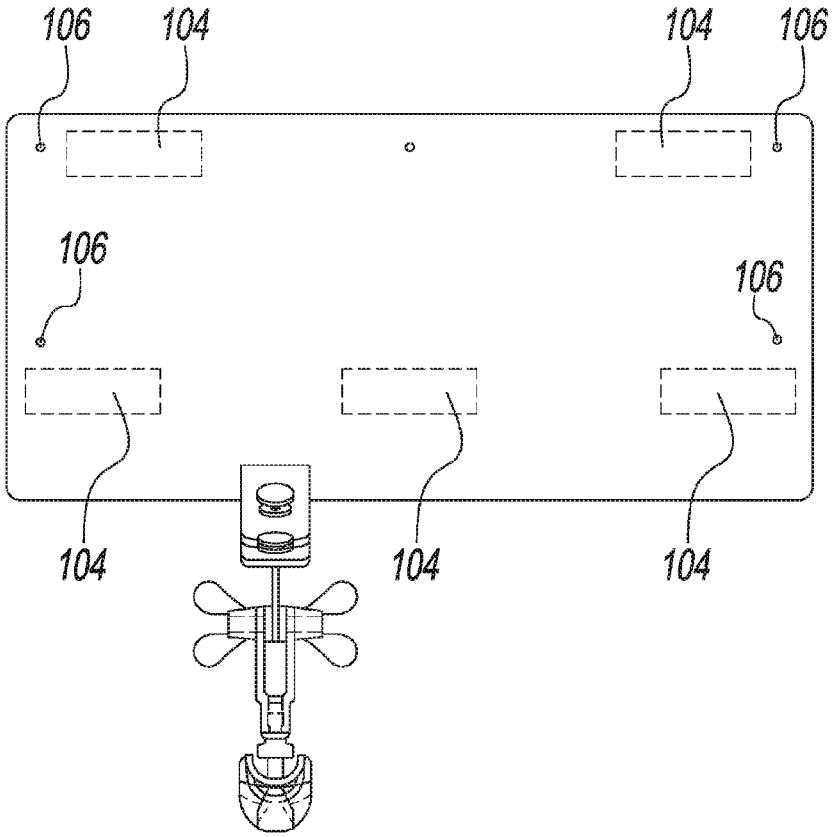
FIG. 5 is a top view of FIG. 1.
Figure 6:
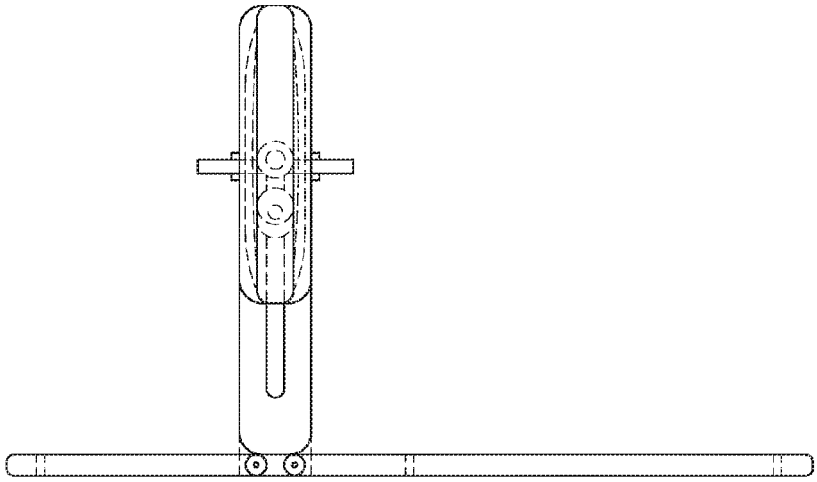
FIG. 6 is a front view of FIG. 1.
Figure 7:
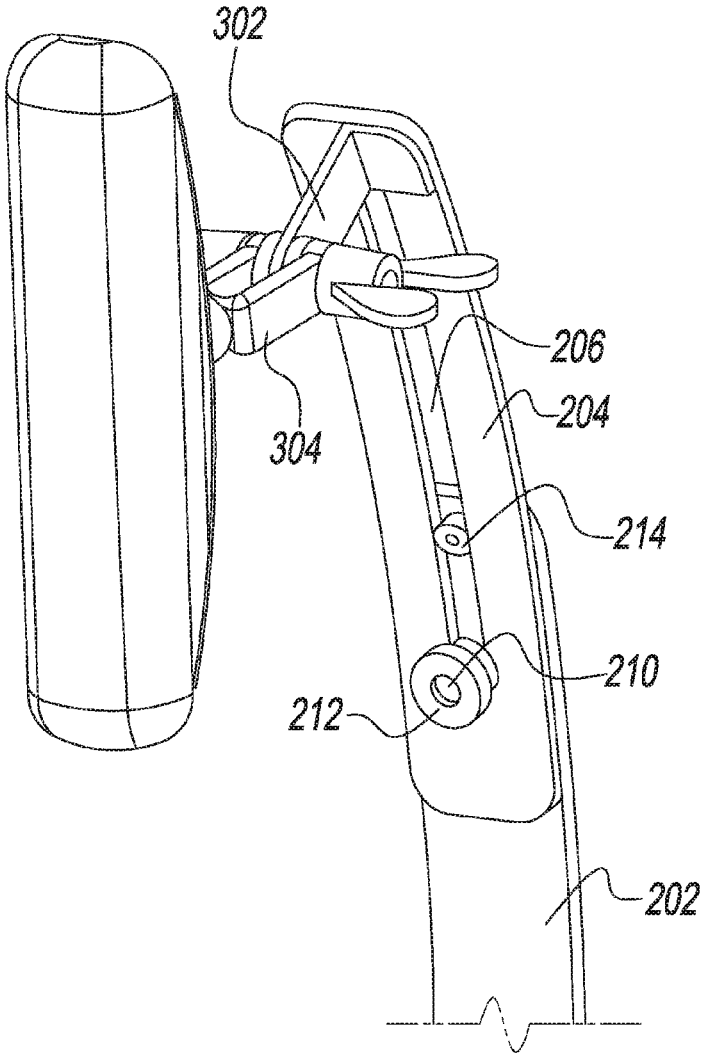
FIG. 7 is a close-up view of the vertical arm portion in a semi-extended position.

Extending adjacent from one edge of the board 102 is the vertical arm portion 200. The elongated vertical arm portion 200 has a curved configuration that curves away from the board 102 as its height increases. Vertical arm portion 200 comprises a lower section 202 and an upper section 204. The lower section 202 is fixedly connected to the board 102. The upper section 204 has a center slot opening 206 along its axis. A bolt 208 is attached to the lower section 202 with the bolt's threaded shaft 210 extending through slot 206 to slidably engage upper section 204. A nut 212 is attached to the threaded shaft 210 to allow the upper section 204 to be secured to the lower section 202 at a desired position to increase or decrease the height of the vertical arm portion 200. A guide protrusion 214 extends from the lower section 202 in the same direction as the threaded shaft 210 that engages the slot 206 to guide the axial movement of the upper section 204 along the lower section 202. FIGS. 1, 3, 5 and 6 show the vertical arm portion 200 at a retracted position. FIGS. 2 and 4 show the vertical arm portion 200 at an extended position, with increased height and reach away from the board 102. FIG. 7 shows the vertical arm portion 200 at a semi-extended position. In an alternative embodiment, a tightening lever that engages the upper section 204 and the lower section 202 allows movement of the upper section 204 with respect to the lower section 202 to increase or decrease the height when the lever is in a released position. Indented gearing elements are provide within the upper section 204 that engages the lower section 202 to allow controlled movement. Once the desired height is found, the lever may be tightened to lock into position the upper section 204 with respect to the lower section 202.

Extending from the upper section 204 of the vertical arm portion 200 is the horizontal arm portion 300. Horizontal arm portion 300 comprises a first link 302 and a second link 304 that are pivotably connected to each other. The first link 302 is connected to the upper section 204 of the vertical arm portion 200. The second link 304 is connected to first link 302 via a threaded shaft 306 having butterfly nuts 308 at both ends. The shaft 306 and butterfly nuts 308 allow the second link 304 to be pivotable at different angle and height with respect to first link 302.

Support portion 400 is connected to the second link 304 of the horizontal arm portion 300. Support portion 400 comprises an elongated cushion 402 having a central pole 404 extending therefore, forming a T-shape. Central pole 404 is rotatably connected to the distal end of the second link 304 of the horizontal arm portion 300 such that cushion 402 maybe positioned in vertical alignment (as shown in the figures) or in a horizontal alignment (not shown). Support portion 400 may be removably connected (such as a push pull connector) to horizontal arm portion 300 to improve portability of the posture support system 10.

Figure 8:
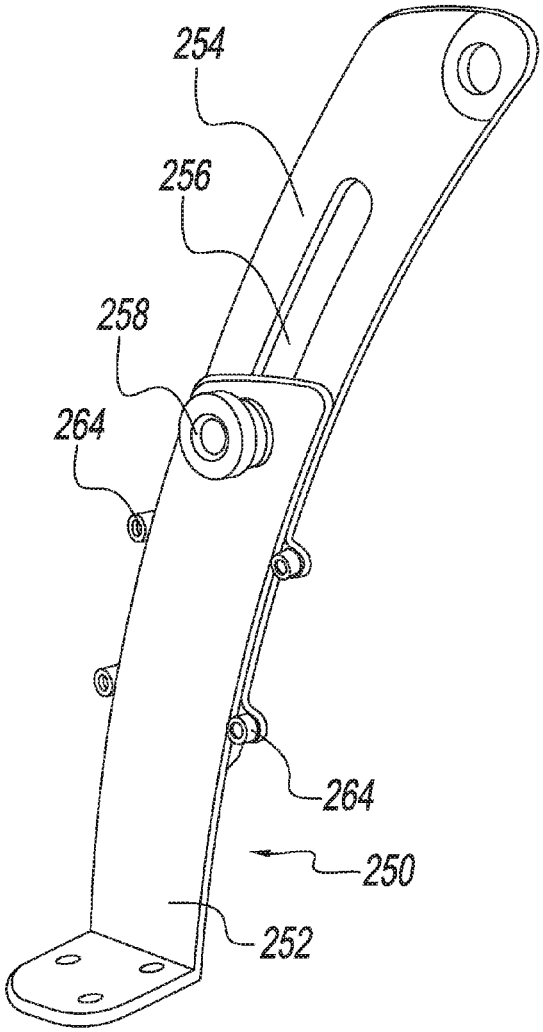
FIG. 8 is a perspective view of an alternate embodiment of vertical arm portion of the present invention.
Figure 10:
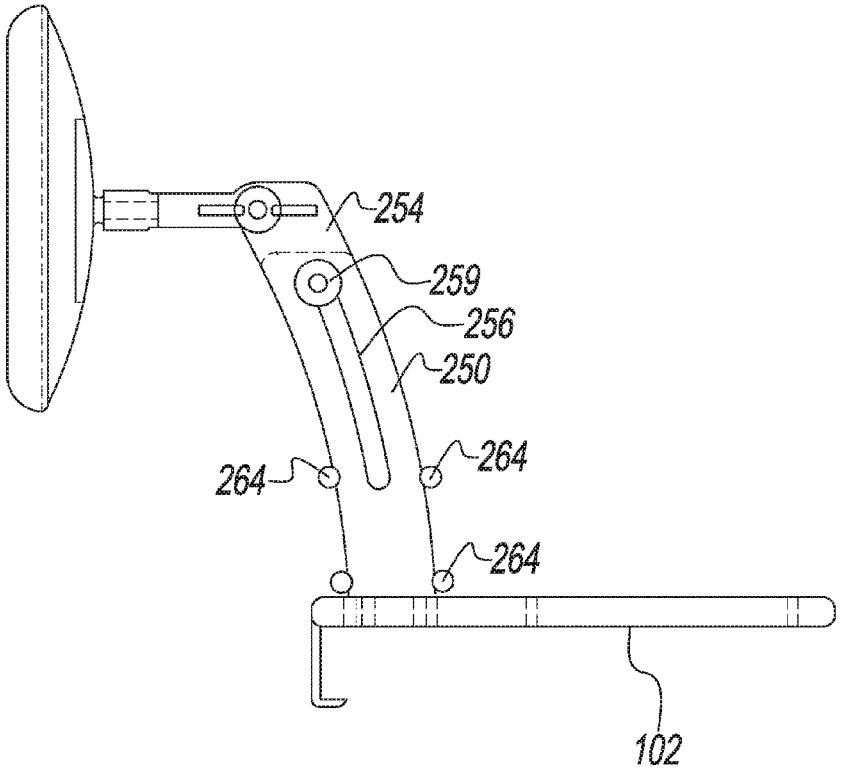
FIG. 10 is a side view of an alternative embodiment of the present invention with the vertical arm portion shown in FIG. 8.

FIGS. 8 and 10 show an alternate embodiment of the vertical arm portion 250. Similar to the vertical arm portion 200, the vertical arm portion 250 has a curved configuration that curves away from the board 102 as its height increases. Vertical arm portion 250 comprises a lower section 252 and an upper section 254. The lower section 252 is fixedly connected to the board 102. The upper section 254 has a center slot opening 256. A bolt 258 is attached to the lower section 252 with the bolt's threaded shaft (not shown) extending through slot 256 to slidably engage upper section 254. A nut 259 is attached to the threaded shaft to allow the upper section 254 to be secured to the lower section 252 at a desired position to increase or decrease the height of the vertical arm portion 250. A plurality of guide extensions 264 extends from the upper section 254 towards and abuts the edges of the lower section 252 to guide the movement of the upper section 254 along the lower section 252.

Figure 9:
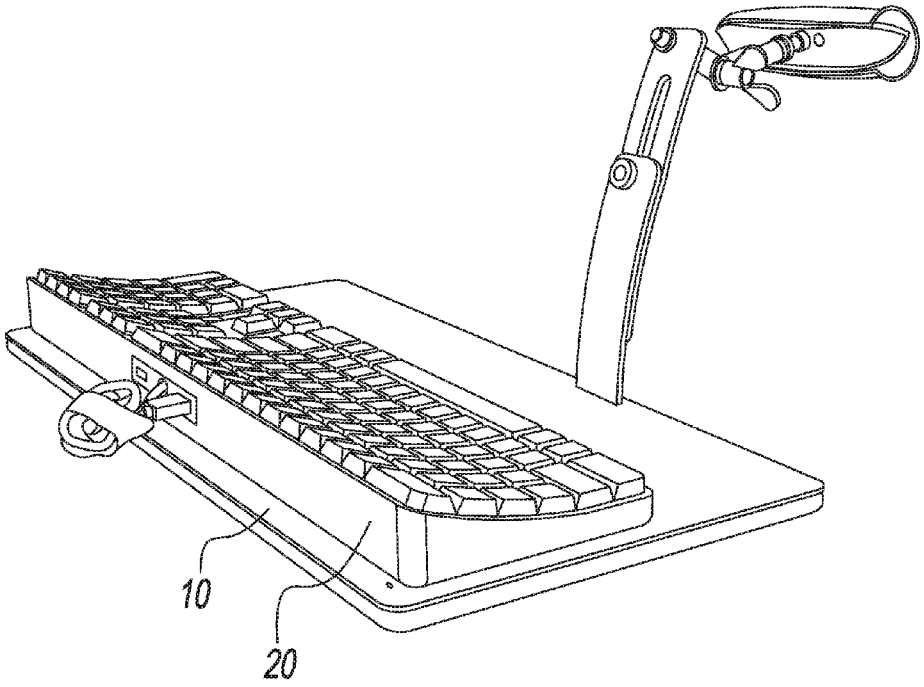
FIG. 9 illustrates the present invention when in use.

FIG. 9 shows the posture support system 10 being used by a user. The board 102 is placed adjacent an edge of a flat surface such as a table. A keyboard 20 being used by the user is placed on the board 102. The height and angle of the vertical arm portion 200, the horizontal arm portion 300 and the support portion 400 are adjusted to the comfort of the user, with the cushion 402 positioned in either a horizontal or vertical alignment at the level of the user's upper chest area. When the user sits at the table with his chest in contact with the cushion 402, the user's spine is properly aligned to its natural curvature. The user leans against the posture support system 10, due to the curvature of the vertical arm portion 200, it flexes slightly to provide a more flexible and comfortable support for the user. The board 102 may be placed further away from instead of adjacent to the edge of the table if it is more comfortable to the user.

FIGS. 11 to 14 show a posture support system 20 of the present invention, which comprises a base portion 120, a vertical arm portion 220, a horizontal arm portion 320, and a support portion 420. Base portion 120 is similar to base portion 100 of FIG. 1, comprises a rectangular shape board 122, except that two spaced apart tabs 124 are provided on an edge that abuts the edge of a flat surface. Tabs 124 are intended to abut an edge of the flat surface to align the board 122 against the edge of the flat surface and to prevent movement of the board 122 from the edge of the flat surface. Each tab 124 optionally has an opening 126 for receiving fasteners that secure the board 122 to the flat surface.

Extending adjacent from one edge of the board 122 is the vertical arm portion 220. The elongated vertical arm portion 220 is similarly positioned and curved as the vertical arm portion 120 of FIG. 1. Vertical arm portion 220 comprises an outer section 222 and an inner section 224. The outer section 222 is fixedly connected to the board 122. The outer section 222 has an inner channel that receives inner section 224 and allows inner section 224 to be slide in and out with respect to the outer section 222 to increase or decrease the height of the vertical arm portion 220.

Pivotably connected to the distal end of the inner section 224 of the vertical arm portion 220 is the horizontal arm portion 320. The horizontal arm portion 320 comprises a first link 322 having one end connected to the distal end of the inner section 224 and the opposite end rotatably and pivotably connected to the support portion 420 via a ball joint or other similar connection. Support portion 420 is similar to support portion 400 of FIG. 1 and comprises an elongated cushion 422, but without a central pole 404. The side of the support portion 420 facing the horizontal arm portion 320 is an elongated groove 426. The first link 322 of the horizontal arm portion 320 and the support portion 420 forms a T-shape.

The posture support system 20 further comprises a compression portion 500. The compression portion 500 comprises a generally oval shape ring 502 that can be compressed under pressure, with the first link 322 positioned to pass through the minor axis of the oval ring 502. Ring 502 engages the elongated groove 426 to hold the support portion 420 in a relatively stable position. Due to the oval shape and compressibility of ring 502, it advantageously allows supported pivotal movement of the support portion 420 to increase a user's comfort when the user leans against the cushion 422.

FIGS. 15 to 20 show a posture support system 30 of the present invention, which comprises a base portion 140, a vertical arm portion 240, a horizontal arm portion 340, a support portion 440 and a compression portion 520. Base portion 140 is similar to base portion 120 of FIG. 11, comprises a rectangular shape board 142, except that a lip 144 is provided along an edge that abuts the edge of a flat surface. Lip 144 is intended to abut an edge of the flat surface to align the board 142 against the edge of the flat surface and to prevent movement of the board 142 from the edge of the flat surface. The lip 144 optionally has one or more opening 146 for receiving fastener(s) that secure the board 142 to the flat surface.

Figure 11:
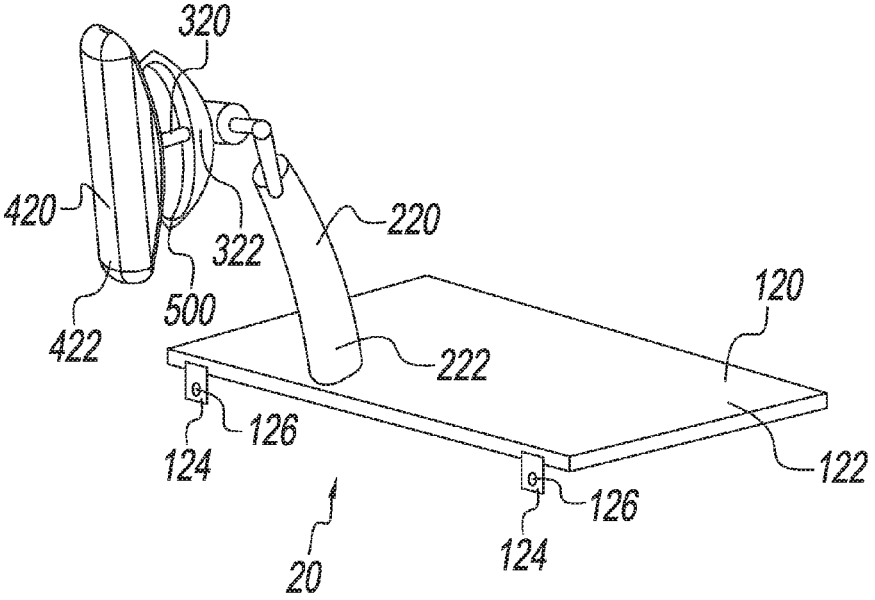
FIG. 11 is an alternate embodiment of the present invention.
Figure 12:
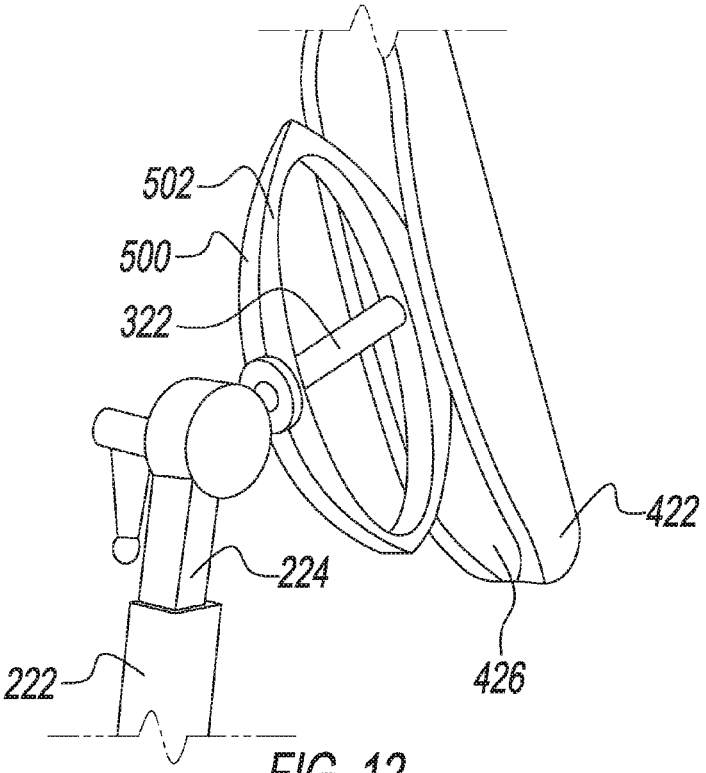
FIG. 12 is an enlarged view of the horizontal arm and support portions of FIG. 11.
Figure 13:
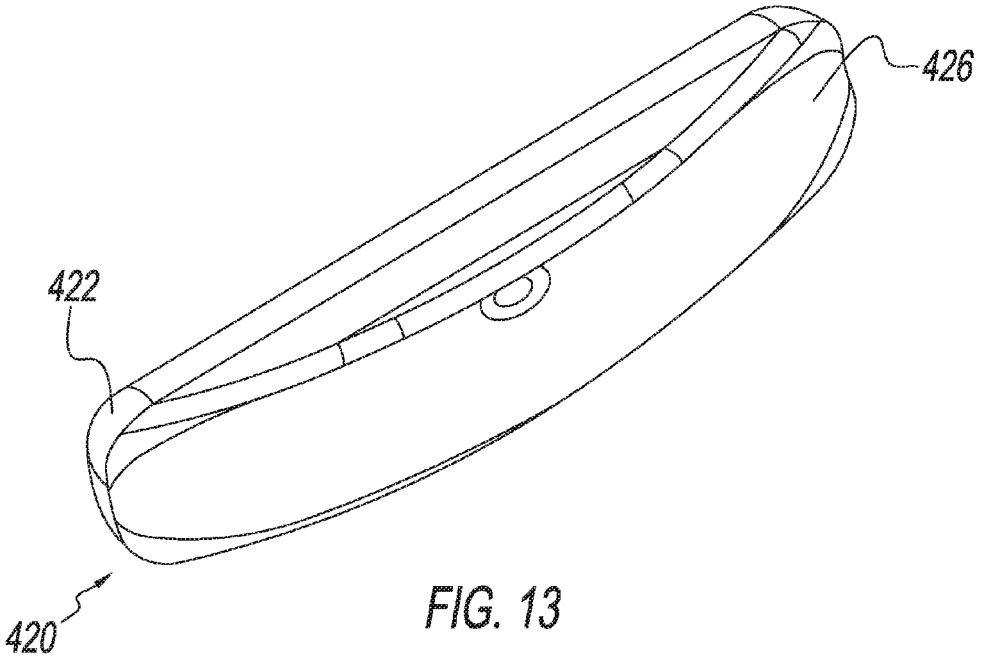
FIG. 13 is the support portion of FIG. 11.
Figure 14:
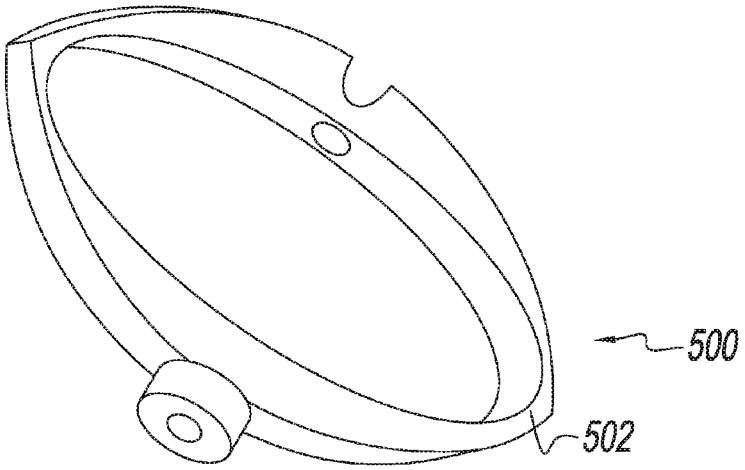
FIG. 14 is the compression portion of FIG. 11.

Extending adjacent from one edge of the board 142 is the vertical arm portion 240, which is similar to vertical arm portion 220 of FIG. 11. Pivotably connected to the distal end of the vertical arm portion 240 is the horizontal arm portion 340. The horizontal arm portion 340 comprises a first link 342 having a tubular body 344 with a spring-loaded insert 346 therein extending from the distal end. At the distal end of the first link 342 is pin 348.

Support portion 440 is similar to support portion 420 of FIG. 11 and comprises an elongated cushion 442 and having an elongated groove 446. Along the groove 446 is a plurality sets of positioning elements 448*a*, 448*b* and 448*c*. Pin 348 of the first link 342 is pivotably attached to elongated groove 446.

Compression portion 520 is similar to compression portion 500 of FIG. 11 and comprises a generally oval shape ring 522 that can be compressed under pressure, with the first link 342 positioned to pass through the minor axis of the oval ring 522.

Ring 522 engages the positioning elements 448*a* and 448*c* along with a plurality of protrusions 524 that engages the set of positioning elements 448*b* to hold the support portion 440 in a relatively stable position. Due to the oval shape and compressibility of ring 522, it advantageously allows supported pivotal movement of the support portion 420 to increase a user's comfort when the user leans against the cushion 442. Posture support system 30 further allows supported axial movement along the minor axis of the ring 522 due to the spring-loaded insert 346, which allows the ring 522 to compress against pressure applied to the cushion 442.

Figure 15:
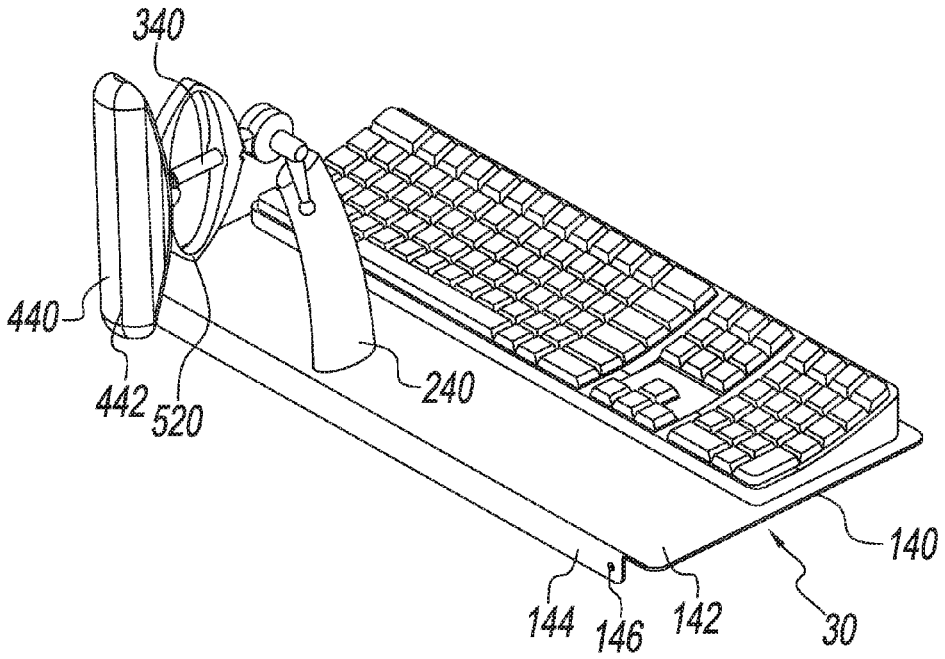
FIG. 15 is an alternate embodiment of the present invention.
Figure 16:
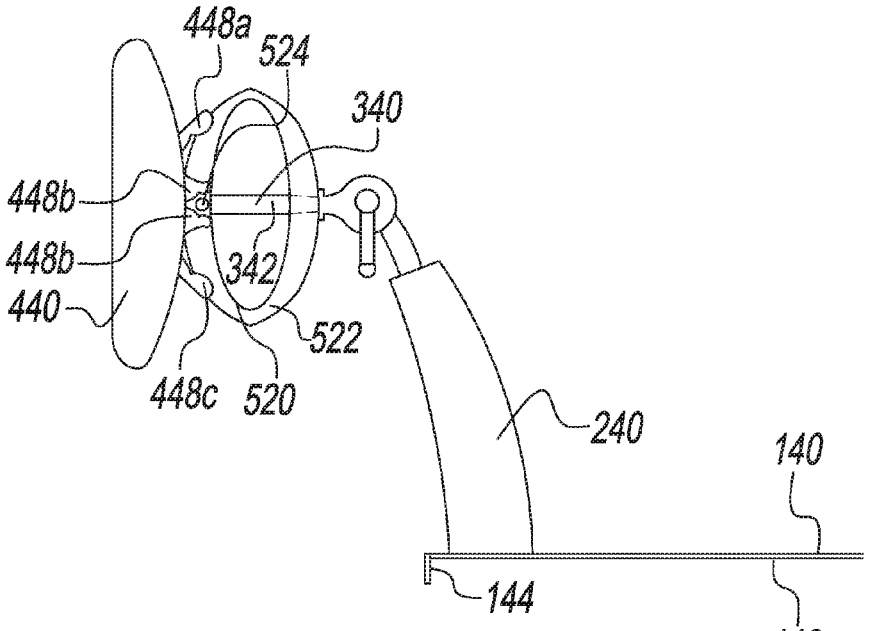
FIG. 16 is a side view of FIG. 15.
Figure 17:
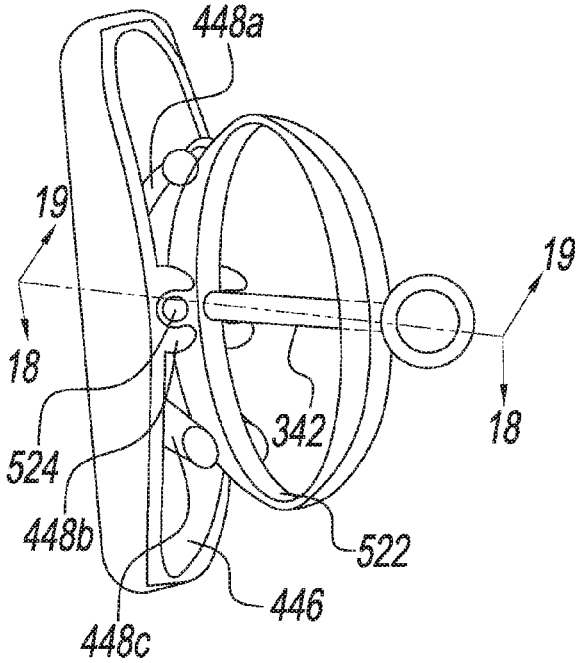
FIG. 17 is an enlarged view of the horizontal arm and compression portions of FIG. 15.
Figure 18:
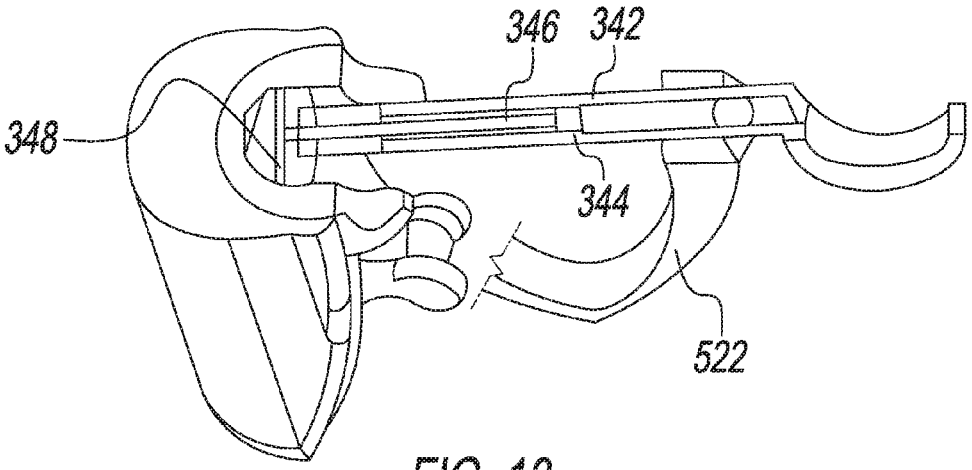
FIG. 18 is a cross-sectional view of FIG. 17 taken at line 18-18.
Figure 19:
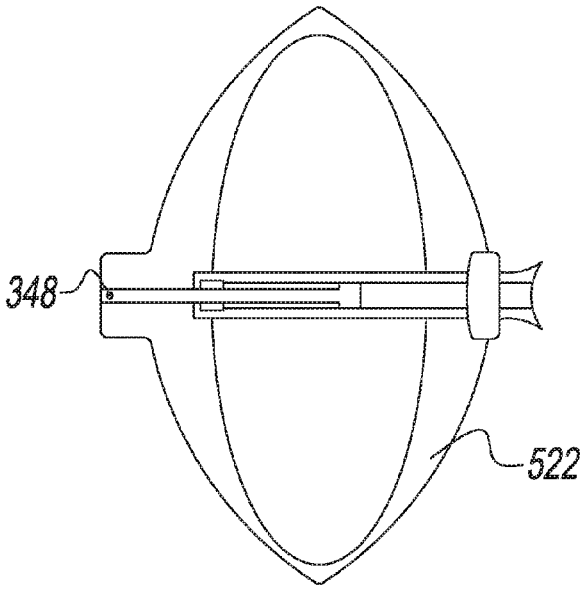
FIG. 19 is a cross-sectional view the horizontal arm and compression portions of FIG. 17 taken at line 19-19.
Figure 20:
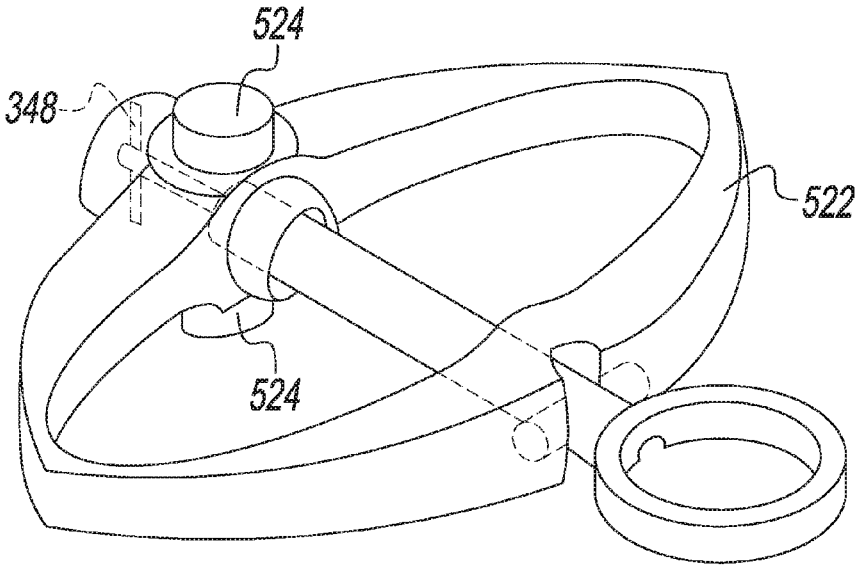
FIG. 20 is a perspective view of the horizontal arm compression portions of FIG. 17.
Figure 21:
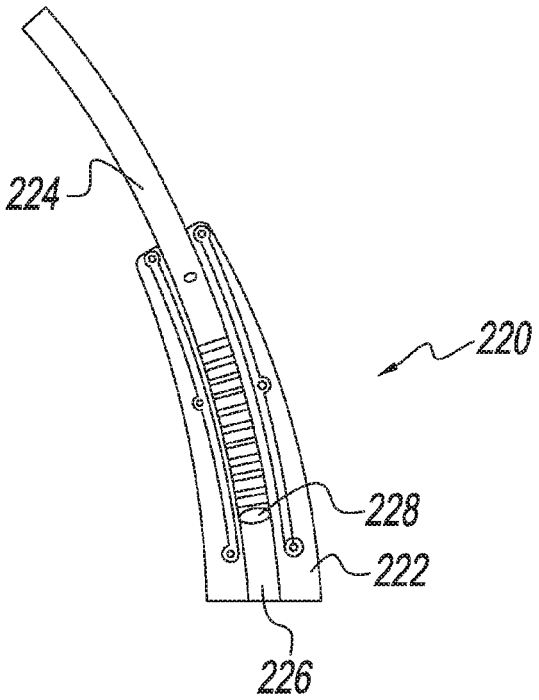
FIG. 21 is a cross-sectional view of the vertical arm portion of FIGS. 11 and 15.
Figure 22:
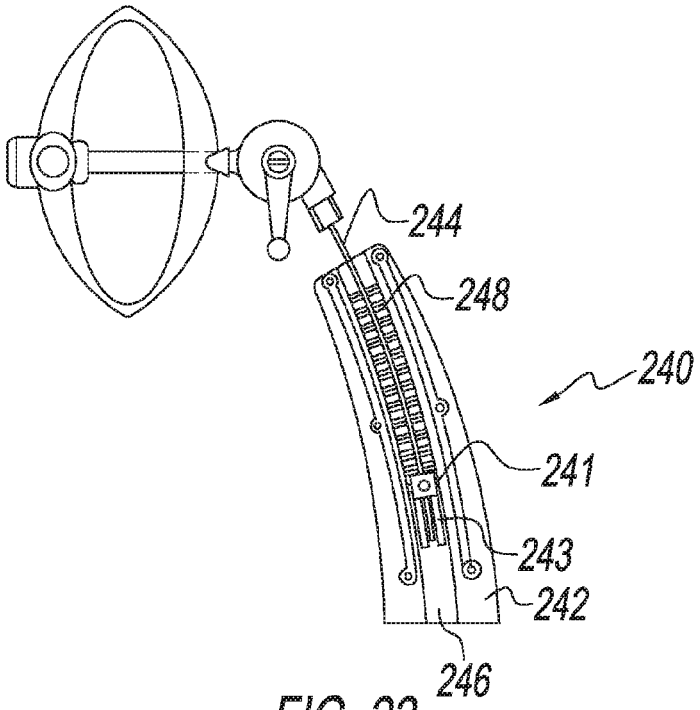
FIG. 22 is a cross-sectional simplified view of an alternate vertical arm portion.
Figure 23:
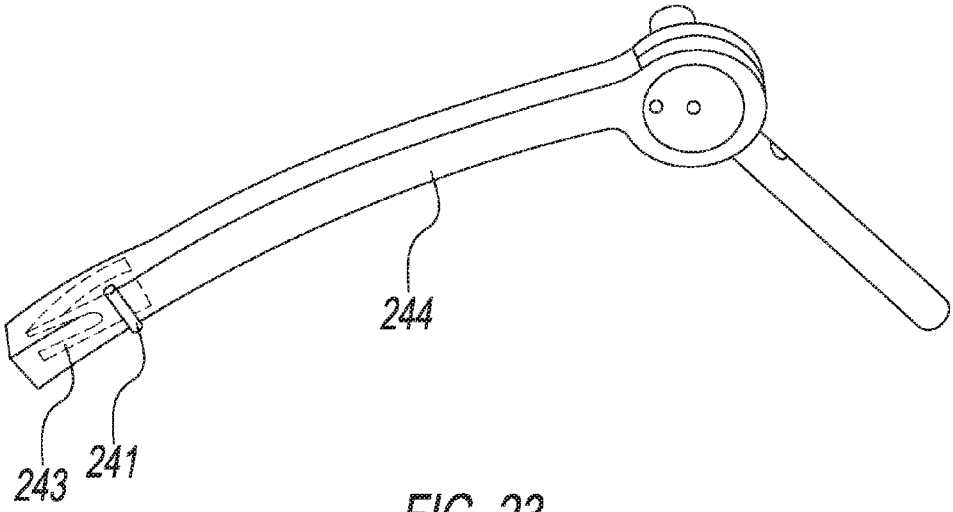
FIG. 23 is another view of the vertical arm portion of FIG. 22.
Figure 24:
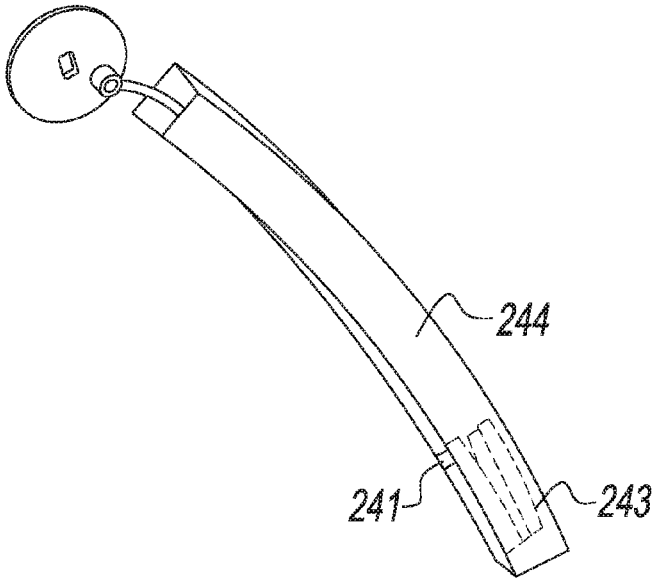
FIG. 24 is an opposite view of FIG. 23.
Figure 25:
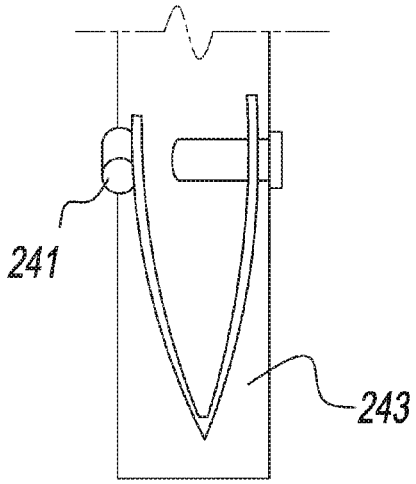
FIG. 25 is an enlarged view of the spring feature of the inner section of the vertical arm portion as shown in FIGS. 22 and 23.

FIG. 21 shows an embodiment of the vertical arm portion 220 or 240 of FIG. 11 or 15. The inner channel 226 of the outer section 222 has a plurality of spaced apart detents 228. The inner section 224 has a protrusion (not shown) that corresponds to and engages the detent 228 such that the inner section 224 can be slide-click in and out with respect to the outer section 222 to increase or decrease the height of the vertical arm portion 220.

FIGS. 22 to 25 show another embodiment of vertical arm portion 220 or 240 of FIG. 11 or 15. Similar to the vertical arm portion 220 shown in FIG. 21, the inner channel 246 of the outer section 242 has a plurality of spaced apart detents 248. The inner section 244 has a protrusion 241 that corresponds to and engages the detent 248 and is attached to a V-shape spring 243 such that the inner section 244 can be slide-click in and out with respect to the outer section 242 to increase or decrease the height of the vertical arm portion 240. The V-shape spring 243 aids in maintaining the positioning of the inner section 244 with respect to the outer section 242 to prevent accidental disengagement of the protrusion 241 from detent 248.

Figure 26:
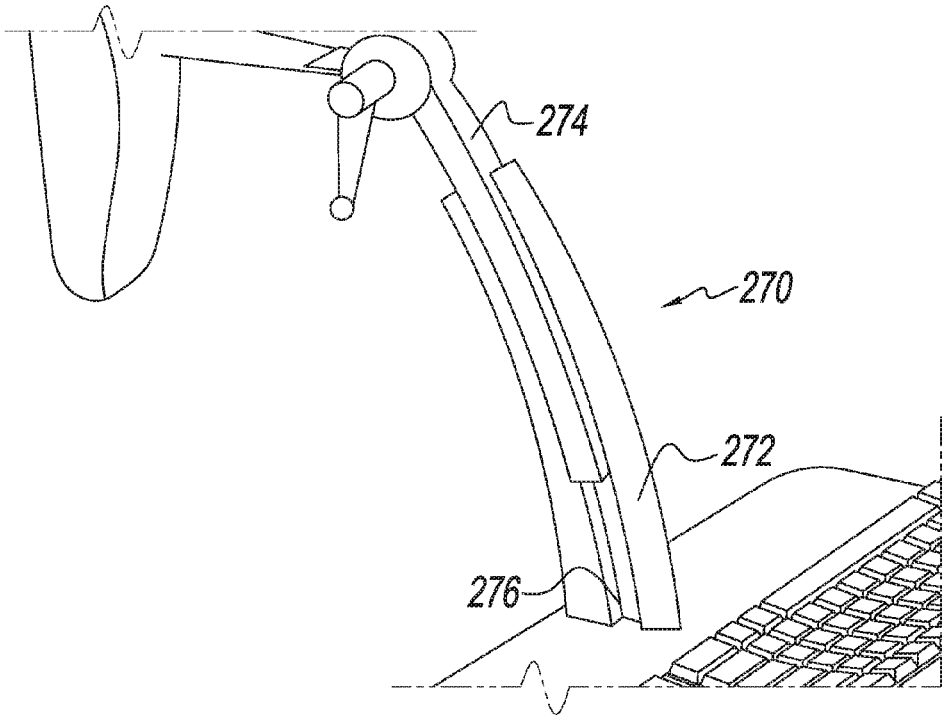
FIG. 26 is an alternate vertical arm portion.

FIG. 26 shows another embodiment of vertical arm portion 270 comprises a lower section 272 and an upper section 274. The lower section 272 has a recess 276 that corresponds and slidably receives the upper section 274. Upper section 274 can be slid along recess 276 to increase or decrease the height of the vertical arm portion 270.

Figure 27:
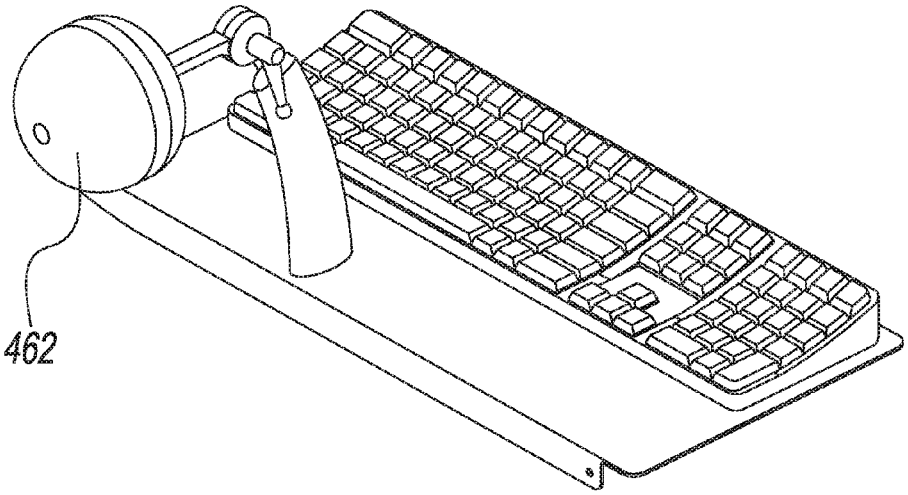
FIG. 27 is an alternate embodiment of the cushion of the support portion.
Figure 28:
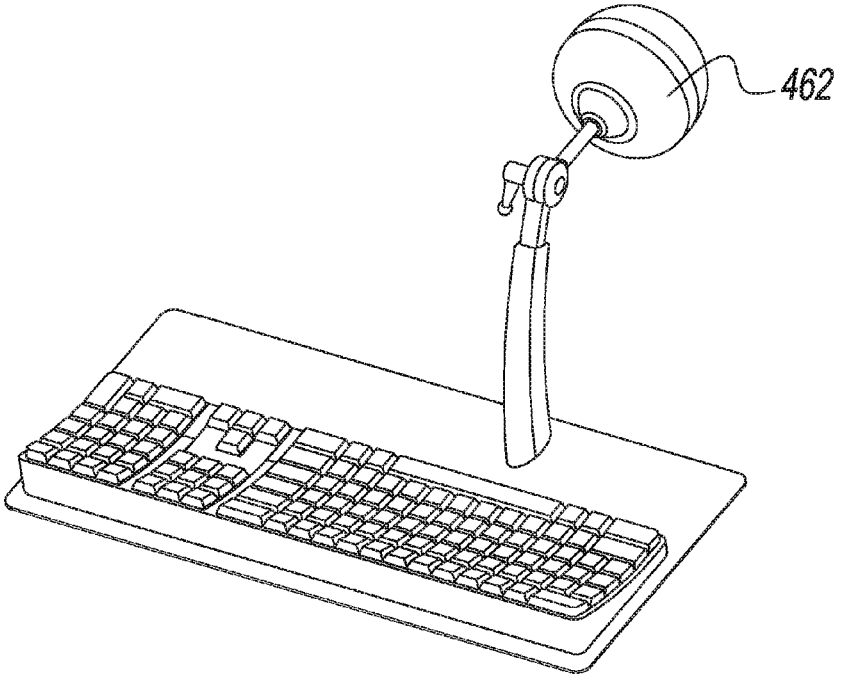
FIG. 28 is an opposite view of FIG. 27.

FIGS. 27 and 28 show an alternate cushion 462 for the support portion 400, 420 or 440. Instead of an elongated cushion, cushion 462 is a ball or round shape preferably made of a foam material. It may also be made of rubber, silicone, etc.

The features of the invention illustrated and described herein is the preferred embodiment. Therefore, it is understood that the specification is intended to cover unforeseeable embodiments with insubstantial differences that are within the spirit of the specification.

What I claim is:

1. A posture support system, comprising:

a. a table having an upper flat surface and a perimeter;

b. a keyboard having a predetermined dimension; and c. a posture support comprises:

i. a base portion being substantially flat and having an upper flat surface and a lower flat surface removably attachable to said upper flat surface of said table such that the entire lower flat surface of said base portion engages the upper flat surface of said table within said perimeter of said table, said base portion has a dimension larger than said predetermined dimension of said keyboard such that said keyboard is placed entirely on said upper flat surface of said base portion;

ii. a vertical arm portion having first and second ends extending from said upper flat surface of said base portion, said vertical arm portion slightly curves away from said base portion towards the user;

iii. a horizontal arm portion having first and second ends extending from said second end of said vertical arm portion, said second end of said horizontal arm portion defines an axis; and iv. a support portion rotatably extending from said second end of said horizontal arm portion, said support portion is rotatable 360 degrees around said axis;

wherein said vertical arm portion, horizontal arm portion and support portion are adjustably positionable with respect to each other to allow the user to comfortably rest his upper chest against said support portion when using said keyboard at said table.

2. The posture support system of claim 1 wherein said support portion comprises a cushion.

3. The posture support system of claim 2 wherein said cushion is elongated.

4. The posture support system of claim 2 wherein said cushion is substantially spherical.

5. The posture support system of claim 1 wherein said base portion comprises a rectangular shape board.

6. The posture support system of claim 1 wherein said base portion has an edge, wherein said vertical arm portion extends from adjacent said edge of said base portion.

7. The posture support system of claim 1 wherein said vertical arm portion comprises an upper section and a lower section, said lower section extends from said base portion and said horizontal arm portion extends from said upper section, and said upper and lower sections are slidably movable with respect to each other to increase or decrease the height of the vertical arm portion.

8. The posture support system of claim 7 wherein said vertical arm portion further comprises a fastening element to secure said upper and lower sections to each other at a desired position.

9. The posture support system of claim 1 wherein said horizontal arm portion comprises first and second links pivotably connected to each other to increase or decrease the length and adjust the angle of the horizontal arm portion.

10. The posture support system of claim 9 wherein said horizontal arm portion further comprises a fastening element to secure said first and second links to each other at a desired position.

11. The posture support system of claim 1 wherein said vertical arm portion comprises an outer section and an inner section, said outer section extends from said base portion and said horizontal arm portion extends from said inner section, and said outer and inner sections are slidably movable with respect to each other to increase or decrease the height of the vertical arm portion.

12. The posture support system of claim 11 wherein said outer section having an inner channel for slidably receiving said inner section.

13. The posture support system of claim 12 wherein said inner channel having a plurality of spaced apart detents, said inner section having a protrusion that correspondingly engages one of said detents such that said inner section can be slide-click in and out with respect to said outer section.

14. The posture support system of claim 13 wherein said inner section further having a V-shape spring and said protrusion is attached to said V-shape spring.

15. The posture support system for a user for use in connection with a flat surface, comprising:

a. a base portion adapted to be removably attachable to the flat surface;

b. a vertical arm portion having first and second ends extending from said base portion;

c. a horizontal arm portion having first and second ends extending from said second end of said vertical arm portion;

d. a support portion rotatably extending from said second end of said horizontal arm portion having an elongated groove; and:

e. a compression portion having a generally oval shape ring with said horizontal arm portion passing through a minor axis of said ring, said ring engages said elongated groove to hold said support portion in a relatively stable position, wherein said vertical arm portion, horizontal arm portion and support portion are adjustably positionable with respect to each other to allow a user to comfortably rest his upper chest against said support portion.

16. The posture support system of claim 15 wherein said support portion further has a plurality of sets of positioning elements; said horizontal arm portion comprises a first link having a tubular body with a spring-loaded insert therein extending from the distal end, a pin at said distal end of said insert pivotably connected to said elongated groove;

wherein said first link of said horizontal arm portion passes through the minor axis of said ring, said ring engages said plurality of sets of positioning elements to hold said support portion in a relatively stable position;

wherein pressure applied against the support portion by a user causes compression of said ring and said spring-loaded insert to provide supported axial movement along the minor axis of the ring.

* * * * *